US006487504B1

(12) United States Patent
Girgensohn

(10) Patent No.: US 6,487,504 B1
(45) Date of Patent: Nov. 26, 2002

(54) METHOD OF DETERMINING THE FRICTION BETWEEN STRAND SHELL AND MOLD DURING CONTINUOUS CASTING

(75) Inventor: Albrecht Girgensohn, Dusseldorf (DE)

(73) Assignee: SMS Schloemann-Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 09/539,304

(22) Filed: Mar. 30, 2000

(30) Foreign Application Priority Data

Apr. 3, 1999 (DE) ..... 199 15 269

(51) Int. Cl.[7] ..... B22D 11/16; G01B 3/44

(52) U.S. Cl. ..... 702/33; 164/154; 164/416; 164/452; 164/478; 164/481

(58) Field of Search ..... 164/154, 416, 164/418, 452, 478, 481, 482; 702/33, 34, 105, 113, 114, 183

(56) References Cited

U.S. PATENT DOCUMENTS

| | | | | | |
|---|---|---|---|---|---|
| 4,566,526 | A | * | 1/1986 | Fastert et al. | 164/478 |
| 4,682,646 | A | * | 7/1987 | Hulek | 164/481 |
| 4,703,789 | A | * | 11/1987 | Reichelt et al. | 164/154 |
| 5,058,656 | A | * | 10/1991 | Hoffken et al. | 164/416 |
| 5,715,888 | A | * | 2/1998 | Kaell et al. | 164/416 |
| 6,179,041 | B1 | * | 1/2001 | Pleschiutschnigg | 164/452 |

OTHER PUBLICATIONS

"Determination of Frictional Forces Between Strand and Mould", Author M. Schmid, Published in Concast News 12, 1973, pp. 6 to 8.

"On the Importance of Mold Friction Control in Continuous Casting of Steel" From "Fachberichte Hüttenpraxis", vol. 20, No. 4, 1982.

"Einsatz Fortgeschrittener Verfahren Zur Zustandsüberwachung Von Kokillenhub– Und –Giessmaschine", Authors M. Perkuhn, E. Höffgen, H.J. Strodhoff, P.M. Frank, From "Vortrag Zur Veranstaltung 3. Duisburger Stranggiesstage AM 7./8. Mar. 1991".

Patent Abstracts of Japan, vol. 010, No. 216 (M–502), Jul. 29, 1986 & JP 61 052973 A (Nippon Kokan KK), Mar. 15, 1986.

Patent Abstracts of Japan, vol. 010, No. 216 (M–502), Jul. 29, 1986 & JP 61 052974 A (Nippon Kokan KK), Mar. 15, 1986.

* cited by examiner

*Primary Examiner*—John S. Hilten
*Assistant Examiner*—John Le
(74) *Attorney, Agent, or Firm*—Friedrich Kueffner

(57) ABSTRACT

A method of determining the friction between the strand shell and the mold during continuous casting with an oscillating mold includes measuring with the use of controlled double-acting hydraulic cylinders and with a predeterminable measuring frequency the pressures of always both chambers of all oscillating cylinders as well as the lifting positions of the pistons corresponding to these pressures, and by computing from these data the friction force acting at any point in time between the strand shell and the mold walls.

7 Claims, No Drawings

METHOD OF DETERMINING THE FRICTION BETWEEN STRAND SHELL AND MOLD DURING CONTINUOUS CASTING

BACKGROUND OF THE INVENTION

1. Field of the Invention

The present invention relates to a method of determining the friction between the strand shell and the mold during continuous casting by means of an oscillating mold.

2. Description of the Related Art

The friction force between the mold wall and the strand shell is caused by a normal force which acts on the strand shell. In conventional molds with parallel planar mold plates, the normal force is produced primarily as a consequence of the ferrostatic pressure which is exerted by the molten steel in the strand interior against the strand shell. An additional portion of the friction force is caused by the conical position of the short sides of the mold.

In molds whose cross-section decreases towards the mold exit, for example, funnel-shaped molds, an additional normal force is produced by the reverse bending of the strand shell as it is transported through the mold.

In accordance with equation (1), the magnitude of the friction force $F_R$ depends on the normal force $F_n$ as well as on the coefficient of friction $\mu$.

$$F_R=F_n\times\mu \tag{1}$$

The coefficient of friction $\mu$ is determined primarily by the lubricating conditions between the strand and the shell. These conditions result from:

- selection or quality of the lubricant, for example, casting powder or oil;
- quantity of lubricant added;
- condition of the lubricant with respect to viscosity, composition and texture;
- heat removal from the mold plates;
- relative speed between the strand shell at the mold.

The direction of the friction force changes periodically during the oscillating movement by 180°. In conventional molds, approximately the same friction values are achieved in both directions in the stationary state. On the other hand, because of the additional influence of the bending of the strand shell on the normal force, the friction forces in molds with decreasing cross-section are significantly higher during the phase of the positive strip than during the phase of the negative strip.

Modern continuous casting plants require the highest degree of availability of plant and process because unexpected changes in the casting process caused by lubrication can cause significant reductions of the quality of the cast product as well as interruptions of the operation. Consequently, it is an extremely important prerequisite for a problem-free operation to have a plant which is automated as completely as possible with permanent on-line monitoring of all essential operation data. It is possible in this manner to recognize the tendency of the development of defects early enough and to compensate them with appropriate counter measures.

For this purpose, it is especially necessary to continuously measure the frictional conditions between the strand shell and the mold in order to be able to obtain therefrom findings with respect to the state or condition of operation of the mold, so that the continuous casting process can be monitored and operationally optimized on the basis of this information.

The determination of the frictional conditions between the strand shell and the mold by using measurement technology is also of significant importance because the mold friction force acts on the strand as a pulsating disturbance variable.

Objectives of the on-line monitoring are:

- improvement of the surface quality of the strand by optimizing the lubricating conditions;
- continuous monitoring of the strand lubrication and the oscillation conditions combined with the possibility of a reaction to systematic changes;
- timely warning of harmful events, such as, rupture, of which a recognizable tendency of changes of the mold friction is an indication.

Methods of determining the friction force between strand and mold are known in the prior art. They differ from each other primarily with respect to the selection of the measuring location and the measuring method used.

A method in which the mold is mounted on two load cells is described in a report entitled "Determination of Frictional Forces between Strand and Mould", author M. Schmid, published in Concast News 12, 1973, pages 6 to 8. For preventing the occurrence of additional forces, for example, due to thermal deformation, it is necessary to guide the mold in low-friction needle bearings. In addition to the forces, the casting speed, the mold movement, the mold speed, the occurring forces as well as the mold acceleration are measured. The mold friction is computed from these data.

The document entitled "On the Importance of Mold Friction Control in Continuous Casting of Steel" from "Fachberichte Hüttenpraxis" Metallweiterverarbeitung, Vol. 20, No. 4, 1982, introduces a method of measuring the friction which is based on the measurements of the acceleration of the mold. For this purpose, a measuring head attached to the mold as well as a complicated electronic signal processing unit are required.

The document entitled "Einsatz fortgeschrittener Verfahren zur Zustandsuberwachung von Kokillenhub-undgieβmaschine"[Use of progressive methods for monitoring the conditions of mold lifting and casting machine], authors M. Perkuhn, E. Höffgen, H. J. Strodhoff, P. M. Frank, from "Vortrag zur Veranstaltung 3. Duisburger Stranggieβtage am 7./8. März 1991", a method is described for measuring the force at the eccentric lifting rod which uses as measuring values for the friction force measurement the force in the lifting rod of the eccentric as well as the motor current and the rate of rotation of the eccentric drive, the lifting travel path and the lifting frequency and the cooling water pressure. Using a model replacement system composed of masses, springs and damping units, the forces are computed at the same time which would have to be expected without the influence of the mold friction alone from the oscillating movement. The mold friction can then be determined from a comparison of the measured and expected forces in the lifting rod.

Some of the disadvantages of the methods described above are:

- complicated structural and measuring requirements for obtaining clean measurement signals;
- required retrofitting of mold and/or oscillating devices and of the mold guide means;
- additional external application of measuring equipment which must be cared for, maintained and regularly monitored;
- the required adjustment of the measurement values to vibration models or an interpretation by means of complicated electronic signal processing.

SUMMARY OF THE INVENTION

Therefore, starting from the prior art discussed above, it is the primary object of the present invention to provide a method of the above-mentioned type which avoids the disadvantages and difficulties discussed above and produces with relatively simple measurement technology and insignificant retrofitting of mold or oscillating device clean measurement signals, which does not require external measurement equipment and/or vibration models, and which produces continuously on-line the operation data required for monitoring a problem-free state of operation, particularly for the determination of the friction between the strand shell and the mold.

In accordance with the present invention, this object is met by measuring with the use of controlled double-acting hydraulic cylinders and with a predeterminable measuring frequency the pressures of always both chambers of all oscillating cylinders as well as the lifting positions of the pistons corresponding to these pressures, and by computing from these data the friction force acting at any point in time between the strand shell and the mold walls.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

DESCRIPTION OF THE PREFERRED EMBODIMENTS

The method according to the present invention for determining the friction between the strand shell and the mold during continuous casting can be used in all continuous casting machines which are equipped with a hydraulic mold oscillation.

In accordance with an advantageous feature, only those measurement values are used for determining the friction force which are already required for controlling and regulating the oscillation movement and are measured with sufficient accuracy. These include the measurement data mentioned above, namely:

- the pressures in both chambers of all hydraulic cylinders of the oscillation system; and
- the position of the cylinder pistons at a specific time.

These data are measured with a predetermined measuring frequency. This makes it possible to compute with little mathematical effort on-line and off-line the friction force acting at any given time between the strand shell and the mold wall.

However, it is necessary for this purpose to correct the cylinder forces determined from the measured cylinder pressures by the principal disturbance variables which are weight of the mold at a given time as well as the acceleration forces from the mold movement.

The advantages of the method according to the present invention are:

- the measurement data can be obtained without requiring additional structural or measurement technology because the measurement data are already required for controlling the oscillation movement and are therefore already available with sufficient accuracy;
- this means that also no retrofitting of molds and/or oscillating devices are required;
- the method according to the invention also does not require measurement equipment to be applied externally, so that this equipment also does not have to be cleaned, maintained and monitored.

In accordance with a further development of the method according to the invention, the determined friction forces are assigned to the casting speed at a given time and are continuously compared therewith. This sufficiently eliminates a change of the casting speed as a disturbance variable.

In accordance with another further development of the method of the invention, the acceleration forces are measured in dependence on the respective lifting position during cold operation without friction forces, these acceleration forces are compared with corresponding acceleration forces including the friction forces during normal casting operation, and intended values of the permissible friction forces are derived therefrom.

In accordance with another development of the method of the invention, taken into consideration as additional influencing variables when computing the friction force are parameters concerning the steel quality, casting temperature and casting speed.

The invention also provides that during continuous casting of a charge the measurement data are continuously observed on-line and are registered and the friction force acting at any given time is computed on-line and counter measures are initiated when there are recognizable changes or the casting process is stopped when there is the recognizable danger of rupture.

Finally, it can be provided in the method according to the invention that, when there is the tendency of an increasing friction force between the strand and the mold, the addition of lubricants is examined and the addition of lubricant is changed.

The most important features of the method proposed in accordance with the present invention for measuring the friction force between strand and mold are:

- the method can be used in all mold oscillation systems independently of their type if hydraulic cylinders are used for producing the oscillating movement;
- measurement values are used for determining the friction force which are also required for controlling the oscillation movement and, therefore, are already available with sufficient accuracy;
- the measurement data are measured with a measuring frequency which is suitably predetermined:
- the conversion of the measurement data into actual mold friction takes place by means of simple mathematical relationships and can take place on-line; the present mold weight as well as the acceleration forces from the mold movement are compensated;
- no additional retrofitting of the mold and/or oscillating device is required.

While specific embodiments of the invention have been described in detail to illustrate the inventive principles, it will be understood that the invention may be embodied otherwise without departing from such principles.

I claim:

1. A method of determining a friction force between a strand shell and walls of a mold during continuous casting by means of an oscillating mold using controlled double-acting hydraulic oscillating cylinders for oscillating the mold, the method comprising measuring the pressures of always both chambers of all the oscillating cylinders as well as lifting positions of the pistons corresponding to the pressures with a predeterminable measuring frequency, and computing from the resulting data the friction force acting at any given time between the strand shell and the walls of the mold.

2. The method according to claim 1, comprising correcting the data determined for a dependency of the acceleration forces on the respective lifting positions by the disturbance variables present mold weight and accelerating forces from the mold movement.

3. The method according to claim 1, comprising assigning the determined friction forces to the present casting speed and continuously comparing the friction forces with the casting speed.

4. The method according to claim 1, comprising measuring the acceleration forces in dependence on a respective lifting position during cold operation without friction forces and comparing the acceleration forces to corresponding acceleration forces including the friction forces during casting operation and deriving intended values of the permissible friction forces therefrom.

5. The method according to claim 1, further comprising taking into consideration when computing the friction force as additional variables parameters concerning steel quality, casting temperature and casting speed.

6. The method according to claim 1, comprising continuously observing on-line and registering the measuring data during continuous casting of a charge, and computing on-line the friction force occurring at any given time, and starting countermeasures when recognizable changes occur or stopping the casting process when a recognizable danger of rupture occurs.

7. The method according to claim 6, comprising examining the addition of lubricants when a tendency of increasing friction force between strand and mold occurs and changing the addition of lubricant as required.

* * * * *